US008594837B2

(12) United States Patent
Mazeiller

(10) Patent No.: US 8,594,837 B2
(45) Date of Patent: Nov. 26, 2013

(54) FEED DEVICE WITH IMPROVED ENVELOPE SEPARATION

(75) Inventor: Dominique Mazeiller, La Frette sur Seine (FR)

(73) Assignee: Neopost Technologies, Bagneux (FR)

( * ) Notice: Subject to any disclaimer, the term of this patent is extended or adjusted under 35 U.S.C. 154(b) by 451 days.

(21) Appl. No.: 12/874,841

(22) Filed: Sep. 2, 2010

(65) Prior Publication Data

US 2011/0060453 A1 Mar. 10, 2011

(30) Foreign Application Priority Data

Sep. 8, 2009 (FR) ..... 09 56092

(51) Int. Cl.
*B65G 59/00* (2006.01)

(52) U.S. Cl.
USPC ..... 700/230; 209/586; 271/10.01; 271/109; 271/110; 271/18.1

(58) Field of Classification Search
USPC ..... 700/230
See application file for complete search history.

(56) References Cited

U.S. PATENT DOCUMENTS 3,372,925 A 3/1968 De Vries, et al.
4,953,842 A * 9/1990 Tolmie et al. ..... 271/2
5,029,837 A * 7/1991 Uchiyama ..... 271/110
5,322,269 A * 6/1994 Fukube et al. ..... 271/18.1
6,005,212 A * 12/1999 Van Lierde et al. ..... 209/586
2007/0158895 A1 7/2007 Hamahashi
2009/0174135 A1* 7/2009 Tanaka et al. ..... 271/10.01
2009/0212482 A1* 8/2009 Claris et al. ..... 271/109

FOREIGN PATENT DOCUMENTS

EP 0 856 484 A1 8/1998
EP 2 077 244 A2 7/2009
JP 03-216428 A 9/1991

* cited by examiner

*Primary Examiner* — Gene Crawford
*Assistant Examiner* — Kyle Logan
(74) *Attorney, Agent, or Firm* — Sughrue Mion, PLLC

(57) ABSTRACT

A mailpiece feed device designed to be mounted upstream from a franking machine, and comprising at least a mailpiece feed zone for receiving a stack of mailpieces of various formats supported by a first plurality of drive rollers and a separation zone for individually selecting the mailpieces and having a second plurality of drive rollers, at least first clutch means E3 being provided for actuating said first plurality of drive rollers, said mailpiece feed device further comprising at least one sensor CN for detecting passage of said mailpieces as they enter said separation zone, and control means for subjecting said first clutch means to forced deactivation followed by an activation/deactivation series so long as the sensor CN is not activated, so as to cause a rapid succession of horizontal movements generating jerky motion on said stack, conducive to facilitating mutual separation of said mailpieces.

13 Claims, 4 Drawing Sheets

FEED DEVICE WITH IMPROVED ENVELOPE SEPARATION

TECHNICAL FIELD

The present invention relates exclusively to the field of mail handling and it relates more particularly to a feed device for feeding mailpieces to a franking machine, which feed device procures improved mailpiece separation.

PRIOR ART

Conventionally, a franking machine or "postage meter" must be adapted to receive various types of mailpiece such as documents, letters, or envelopes of various sizes. For this purpose, it is provided, often upstream from it, with an automatic feed device making it possible, in particular to convey such mailpieces at throughput rates suitable for enabling them to be processed by the franking machine. Such an automatic feed device or "feeder" has a deck for receiving a stack of mailpieces of various sizes, and it usually has means for stacking, separating, conveying, and optionally closing the mailpieces that are then processed by the franking machine.

The unstacker means that are constituted by motor-driven drive rollers serve to deliver to the selector means a small set of mailpieces extracted from the stack of mailpieces present on the mailpiece-receiving deck of the feeder, so that said selector means can separate said mailpieces one-by-one while guaranteeing that a predetermined gap is left between successive mailpieces.

The gap between adjacent mailpieces is particularly important because if it is too small the franking machine does not have time to compute the postal imprint, and it must then stop, and, if said gap is too large, the throughput rate at which the mailpieces are franked is reduced significantly.

Unfortunately, the size of the stack of mailpieces and thus its weight has a considerable influence on ease of unstacking, because when the stack is heavy it is very difficult to separate the first mailpieces from the following mailpieces under the stack of mailpieces.

A conventional solution to that problem of mailpiece separation is to increase the speed of rotation of the motor-driven rollers in order to increase the coefficient of friction relative to the stack of mailpieces. However, that solution is ineffective when loss of grip occurs between the rollers and the stack of mailpieces that they support. That is why Patent EP 0 581 392 proposes to mount the drive rollers eccentrics so as to shake the stack vertically, thereby facilitating unstacking thereof. However, in practice, that device is unsatisfactory because the jerky vertical movement does not change the extent to which the various mailpieces in the stack stick together, but on the contrary it does reduce the grip between the drive rollers and the first mailpiece in the stack.

OBJECTS AND DEFINITION OF THE INVENTION

An object of the present invention is thus, essentially, to mitigate the above-mentioned drawback by proposing a mailpiece feed device that is particularly reliable and that makes it possible for the mailpieces to be separated effectively one-by-one. Another object of the invention is to minimize the structural changes that need to be made to conventional feed devices.

These objects are achieved by a mailpiece feed device designed to be mounted upstream from a franking machine, and comprising at least a mailpiece feed zone for receiving a stack of mailpieces of various formats supported by a first plurality of drive rollers and a separation zone for individually selecting the mailpieces and having a second plurality of drive rollers, at least first clutch means being provided for actuating said first plurality of drive rollers, wherein said mailpiece feed device further comprises at least one sensor for detecting passage of said mailpieces as they enter said separation zone, and control means for subjecting said first clutch means to forced deactivation followed by an activation/deactivation series so long as the sensor CN is not activated, so as to cause a rapid succession of horizontal movements generating jerky motion on said stack, conducive to facilitating mutual separation of said mailpieces.

By means of this specific structure that requires merely a sensor at the inlet of the separation zone, and appropriate control of clutching, it is simple to manage separation of the mailpieces by acting merely on the drive rollers of the feed zone.

Depending on the embodiment, said first clutch means are activated/deactivated at least once for a predetermined short duration (said short duration lying in the range 20 milliseconds (ms) to 40 ms) or else said first clutch means are activated/deactivated at least once for a longer predetermined duration (said longer duration lying in the range 40 ms to 60 ms) if said sensor CN is not activated after said first clutch means have been activated/deactivated at least once for a predetermined short duration.

Each short activation/deactivation and each long activation/deactivation is separated from the next by an off period of predetermined short duration (preferably lying in the range 10 ms to 30 ms), and an activation/deactivation series is separated from another activation/deactivation series by an off period of predetermined long duration (preferably lying in the range 30 ms to 50 ms).

Preferably, said sensor is constituted by an optical sensor actuated by an edge of a mailpiece going past.

The invention also provides a control method of controlling clutch means for actuating drive rollers supporting a stack of mailpieces of various formats at a feed zone of a mailpiece feed device designed to be mounted upstream from a franking machine, the control being performed as a function of the state of a sensor CN designed to detect passage of said mailpieces as they enter a separation zone that individually selects the mailpieces at the outlet of said feed zone, said control method consisting in subjecting said clutch means to forced deactivation followed by an activation/deactivation series so long as said sensor CN is not activated, so as to cause a rapid succession of horizontal movements generating jerky motion on said stack, conducive to facilitating mutual separation of said mailpieces.

Said activation/deactivation series of said clutch means may comprise a first activation/deactivation series that is of short duration, followed by a second activation/deactivation series that is of longer duration, and by a third activation/deactivation series that is also of longer duration.

Preferably, the first period of activation of said clutch means ending with said forced deactivation is of the same duration as the periods of activation of short duration that follow.

BRIEF DESCRIPTION OF THE DRAWINGS

Other characteristics and advantages of the present invention appear more clearly from the following description given by way of non-limiting indication, with reference to the accompanying drawings, in which.

DETAILED DESCRIPTION OF A PREFERRED EMBODIMENT OF THE INVENTION

Figure 1:
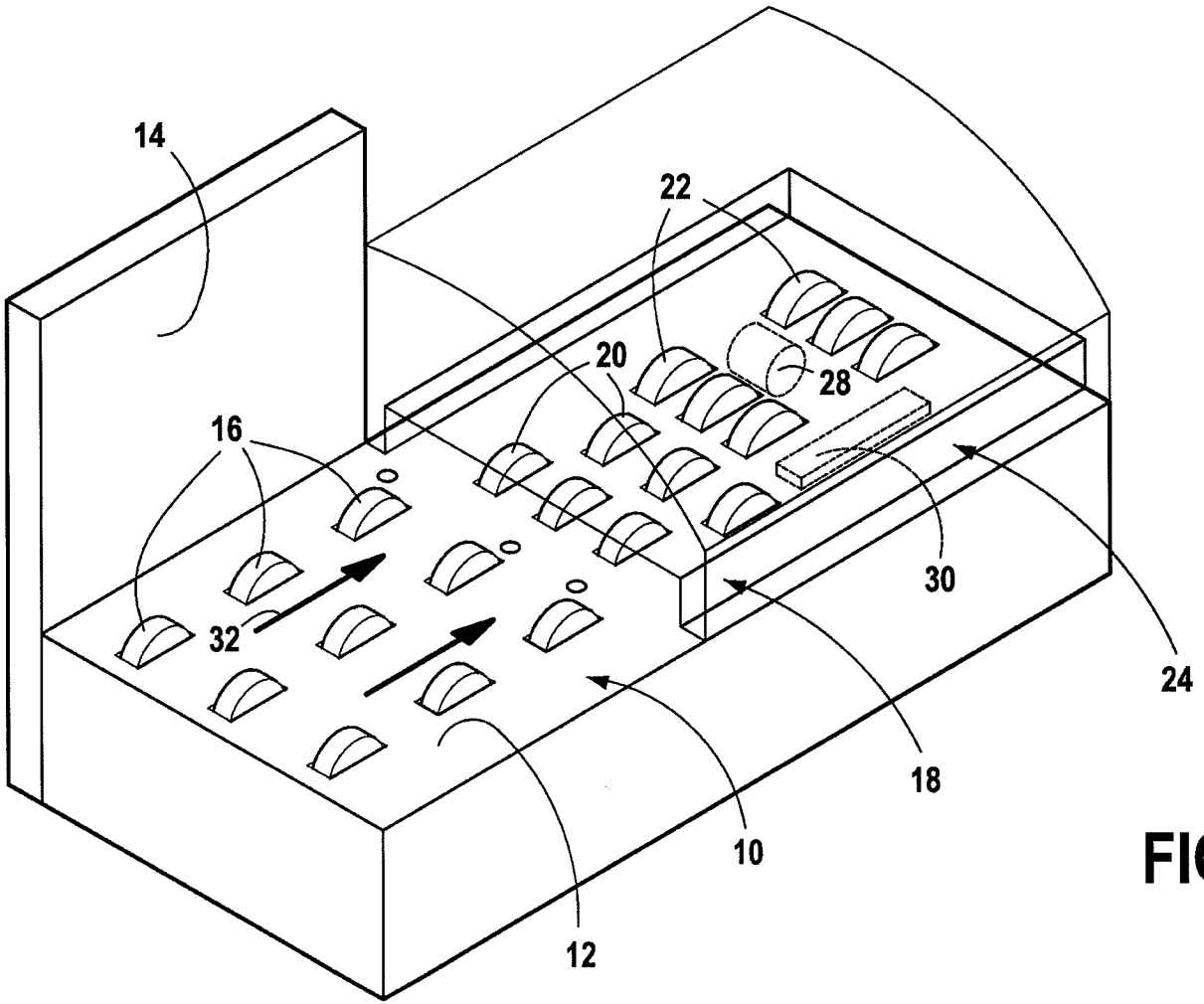
FIG. 1 is a diagrammatic perspective view of a mailpiece feed device of the invention.

The automatic mailpiece feed device of FIG. 1 has a feed zone 10 made up essentially of a mailpiece-receiving deck 12, and of a longitudinal referencing wall 14, and designed to receive a stack of mailpieces dumped as they come (i.e. as a stack of mixed mail) and thus that can be of various sizes and weights. This zone is provided with conveyor means having a first plurality of drive rollers 16 making it possible to move the mailpieces downstream to a separation zone 18 provided with selector means made up of a presser and of a guide (that are not shown) co-operating with a second plurality of drive rollers 20, and from which the mailpieces are extracted individually from the stack. Finally, superposed conveyor means including a third plurality of drive rollers 22 (the associated upper idler rollers are not shown) are provided in a conveying zone 24 at the outlet of said separation zone so as to transfer the mailpieces extracted one-by-one in this way to the franking machine that is disposed downstream.

The feed device also has various known control and monitoring means (not shown except for the main drive motor 28 and a microprocessor control box 30) that are necessary for operation of the feed device, in particular for actuating the various drive rollers 16, 20, 22, while the mailpieces are moving along a conveying path 32, and that it is unnecessary to describe in more detail below.

Figure 2:
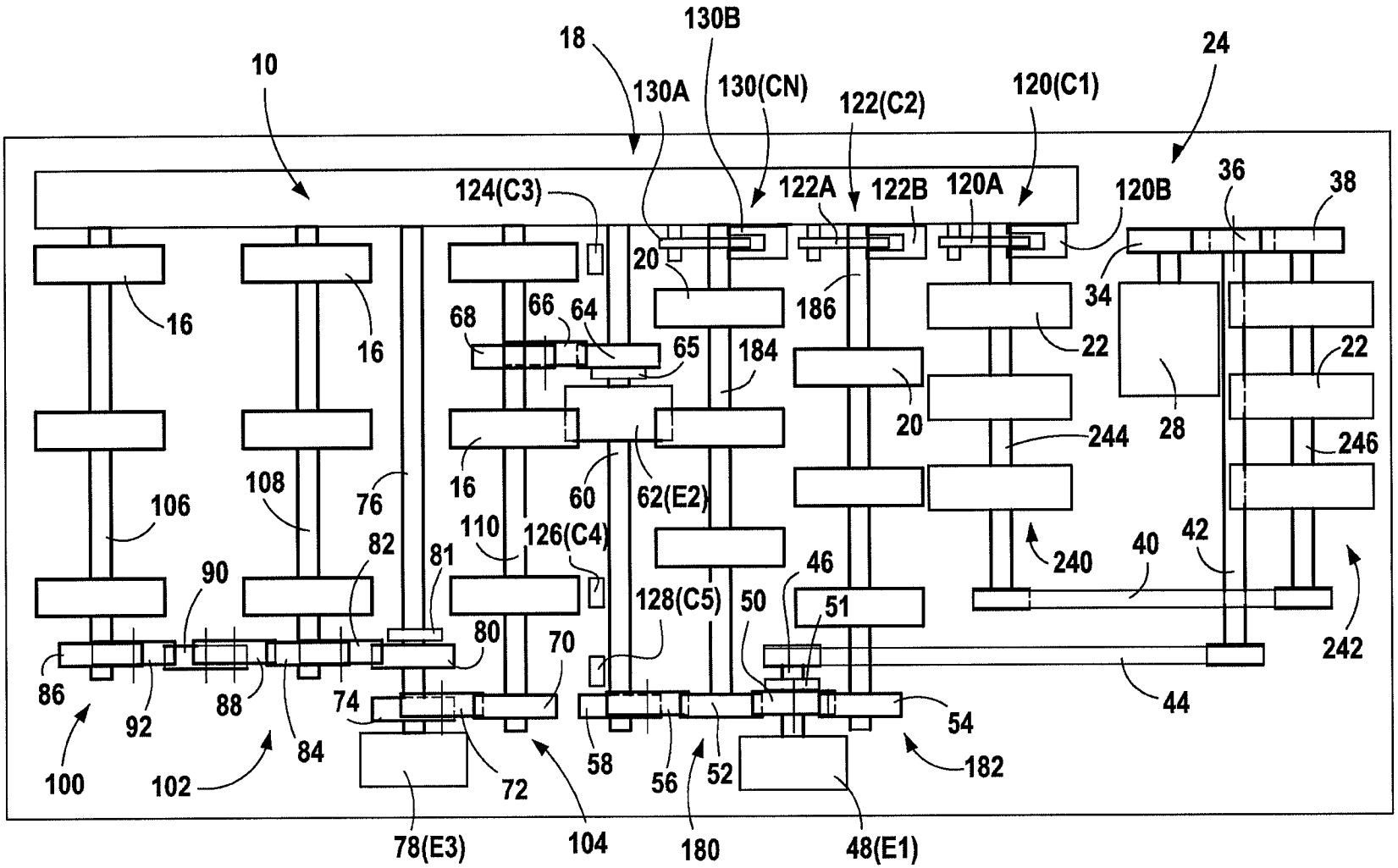
FIG. 2 is a plan view of the internal structure of the device of FIG. 1.
Figure 3:
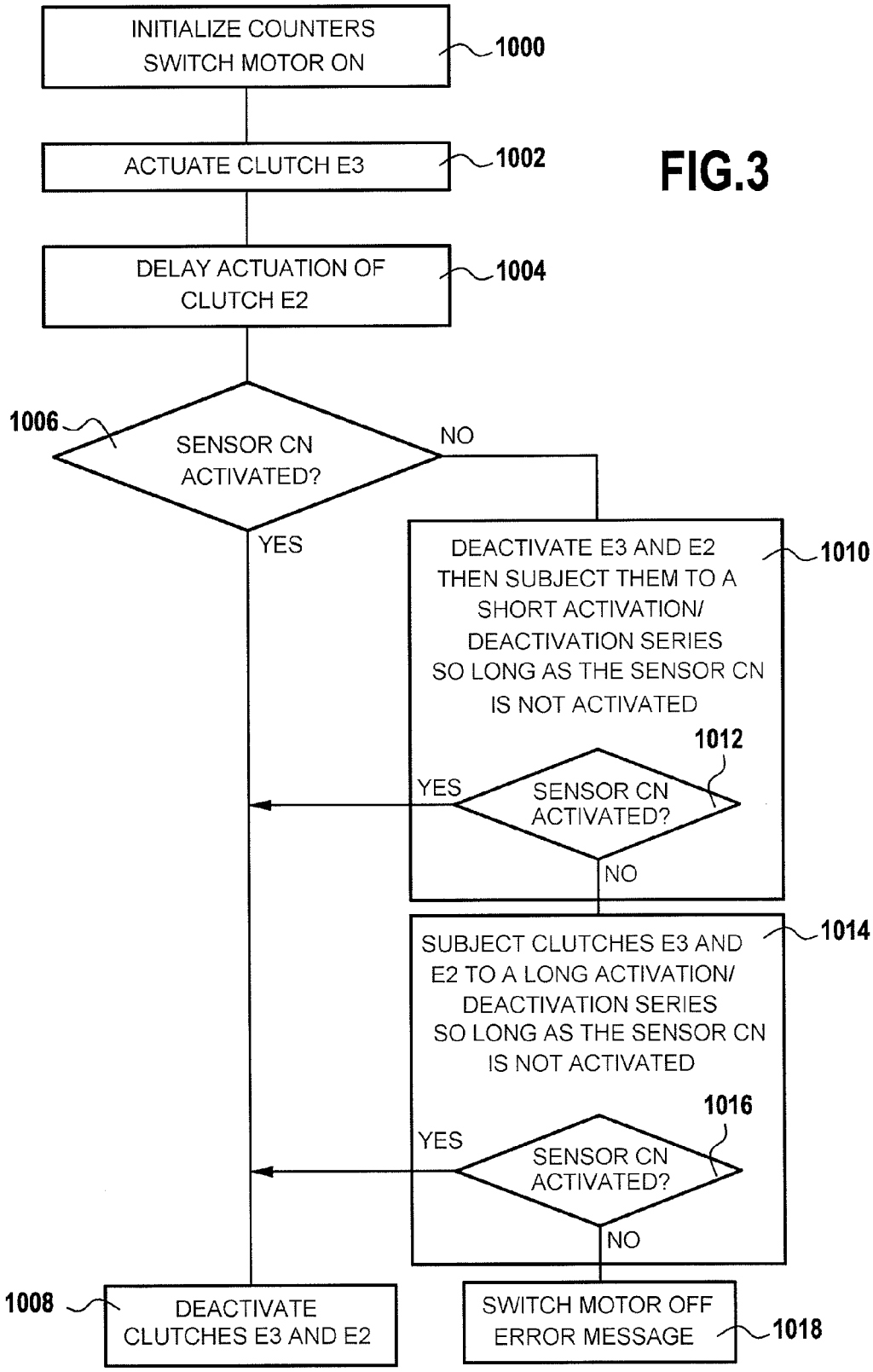
FIG. 3 is a flow chart explaining how the feed device of the invention operates.

FIGS. 2 and 3 show, more precisely, the mechanism for managing the various drive rollers of the automatic feed device. In the direction in which a mailpiece advances along the conveying path 32, this mechanism comprises, in succession, three sets 100, 102, 104 of three drive rollers 16 mounted in parallel manner on three rotary shafts 106, 108, 110 that are disposed perpendicularly to the conveying path 32 at the feed zone 10, two sets 180, 182 of three drive rollers 20 also mounted in parallel manner on two rotary shafts 184, 186 disposed perpendicularly to the transport path 32 at the selection zone 18, and two sets 240, 242 of three drive rollers 22, one set being a back set and the other a front set, and the rollers 22 being mounted on two parallel shafts 244, 246 at the conveying zone 24.

The various drive rollers are actuated from the main motor 28 through a drive transmission made up of cogs, belts, and clutches. For example, the outlet cog 34 of the outlet shaft of the motor 28 is connected via a link cog 36 to a cog 38 of the shaft 246 that carries the front conveyor rollers 22; 242, and this shaft is itself connected to the shaft 244 carrying the back conveyor rollers 22; 240 via a first belt 40. The link cog 36 also drives a first transmission shaft 42 that, via a second belt 44, drives a second transmission shaft 46 on which a first clutch 48 and a drive cog 50 are mounted. This drive cog 50 meshes with both of two cogs 52, 54 on the rotary shafts 184, 186 carrying the conveyor rollers 20 of the selection zone 18.

Actuation of all of the rollers in the separation zone (which rollers are then driven with the rollers of the conveying zone) is possible only if the first clutch (also referenced E1) that controls them is activated simultaneously.

The cog 52 mounted on the rotary shaft 184 that is closer to the feed zone 10 meshes with a first intermediate cog 56 that, in turn, meshes with a cog 58 mounted on a fifth transmission shaft 60 that also carries a second clutch 62 (also referenced E2). Another cog 64 also mounted on the fifth shaft 60 meshes through a second intermediate cog 66 with a cog 68 constrained to rotate with the shaft 110 carrying the feed rollers 16, 104 that are situated closest to the separation zone 18. This shaft carries another cog 70 that, in turn, and via a third intermediate cog 72, drives a cog 74 mounted on a sixth transmission shaft 76 that also carries a third clutch 78 (also referenced E3). This sixth transmission shaft also carries another cog 80 that meshes through a fourth intermediate cog 82 with a cog 84 constrained to rotate with the shaft 108 that carries the second set (or central set) of feed rollers 16; 102. This cog 84 drives a drive cog 86 on the shaft 106 that carries the feed rollers 16; 100 situated at the inlet of the feed zone 10, via three other intermediate cogs 88, 90, 92.

It should be noted that, when it is activated, the second clutch E2 makes it possible to drive the rollers of the last set 104 (the rollers disposed at the outlet of the feed zone) simultaneously with the rollers of the separation and conveying zones, and that the third clutch E3 makes it possible to drive all of the rollers of the feed zone together with the rollers of the other zones of the device, when it is activated.

Free wheels 51, 65, 81 can be disposed on the transmission shafts 50, 64, 80 in order to enable the mailpiece to be removed easily downstream in spite of the clutches E3, E2, E1 being switched off sequentially.

The set 240 of drive rollers 22 of the conveying zone that is closer to the selection zone 18 is provided with a first sensor 120 (C1) for detecting the presence of a mailpiece at the inlet of said conveying zone 24. Similarly, the set 186 of drive rollers 20 of the selection zone 18 that is situated closer to the outlet of the conveying zone is provided with a second sensor 122 (C2) for detecting the presence of a mailpiece in the separation zone, preferably at the outlet of said zone. The two sensors are advantageously of the optical type, and, in the opto-mechanical variant shown, each of them may have a flag or flap 120A, 122A that is actuated by an edge of the mailpiece going past, and that, by pivoting, interrupts the light path of a light-emitting diode (LED) or between two LEDs contained in a housing 120B, 122B that is secured to the body of the feed device.

At the feed zone 10 and perpendicularly to the referencing wall 14, and preferably at the outlet of said feed zone at the third set 104 of drive rollers 16, three other sensors may be disposed for detecting the format of the mailpieces. A third sensor 124 (C3) for detecting small-format mailpieces (i.e. mailpieces of up to about 160 millimeters (mm)) is placed in the immediate vicinity of said wall, and then a fourth sensor 126 (C4) is placed substantially towards the middle portion of said zone for detecting mailpieces of medium format (i.e. in the range approximately 160 mm to approximately 240 mm), and finally a fifth sensor 128 (C5) is placed even further away from the wall 14 for detecting mailpieces of large format (i.e. above about 240 mm). Naturally, the number and the locations of the sensors are in no way limiting. It is quite possible to have a different number of sensors, and in particular to have as many sensors as there are mailpiece formats to be detected.

In accordance with the invention, an additional sensor 130 (CN) is provided in the separation zone 18, and more precisely on the set 184 of drive rollers 20 situated at the inlet of said zone, so as to detect the presence of a mailpiece at the inlet of the separation zone. This additional sensor is advantageously of the optical type, and, in the opto-mechanical variant shown, may also have a flag or flap 130A that is actuated by an edge of the mailpiece going past and that, by pivoting interrupts the light path of an LED or between two LEDs contained in a housing 130B that is secured to the body of the feed device. The purpose of this sensor is to determine whether a mailpiece has left the feed zone 10 and has entered the separation zone 18, and, if not, to act on the clutch E3 in such a manner as to enable said mailpiece to advance.

To this end, and in accordance with the invention, the clutch E3 (and correlatively the clutch E2 that follows after a delay) is not, as in the prior art devices, actuated continuously until a mailpiece exits from the separation zone 20 as detected by the sensor 122, but rather it is deactivated and is then subjected to a series of successive activations/deactivations until the edge of said mailpiece appears at the additional sensor 130, in such a manner as to cause a rapid succession of horizontal movements generating a jerky motion conducive to separating the mailpieces from one another. This succession of movements causes repeated acceleration sequences that thus artificially increase the coefficient of friction every time, and effectively assist in separating the mailpieces from the stack.

FIG. 3 is a flow chart showing in detail the various steps of controlling the clutch E3 and, correlatively, the clutch E2, as a function of the state of the sensor 130.

After an initial step 1000 of initializing various counters necessary for operation of the device, at the end of which initialization the main motor 28 is switched on, a step 1002 is performed in which the clutch E3 is actuated, thereby causing the mailpieces to advance from the feed zone 10 towards the selection zone 18, and then, in a following step 1004, after a predetermined time delay, e.g. of 10 ms, clutch E2 is actuated (since these two clutches do not have the same speed, they are not activated at the same time). The following step 1006 is a test step in which the state of the sensor CN is read and, depending on whether or not that sensor is activated, either the clutches E3 and E2 are deactivated normally and directly (answer to step 1006 "yes"), those clutches then ceasing to perform their drive action (step 1008 corresponding to normal feed device operation in which the sensor CN is activated, for example, after 20 ms for a mailpiece-conveying speed of 1.5 meters per second (m/s)), or else the clutch E3 is subjected to forced deactivation (e.g. 25 ms after it was activated when the normal deactivation should have taken place after 20 ms, but forced deactivation of a shorter duration independent of the normal duration is also possible), followed by a first activation/deactivation series that is short and that is performed on the clutch E3 in an attempt to separate the mailpieces, the clutch E2 being deactivated with the clutch E3 and then also being subjected to the same activation/deactivation series (step 1010). If this first succession of on/off cycles does not achieve the desired result, i.e. a mailpiece advancing so that it masks the sensor CN (answer to the test of step 1012 "no"), a second activation/deactivation series that is longer is performed on the clutch E3 (and correlatively on the clutch E2) in a further attempt to separate the mailpieces (step 1014). If, once again, no result is obtained after this second series (answer to the test on masking of the sensor CN in step 1016 "no"), or indeed after a third activation/deactivation series that is long (not shown in the flow chart), the clutches E3 and E2 are then switched off continuously as is the drive motor 28, and an error message is indicated in step 1018.

Each of the various activation/deactivation series of the clutch E3 (and E2) may, for example comprise 10 activations/deactivations, and, in each series of 10, regardless of whether it is short or longer, each period of activation is separated from the next one by a short off period that is identical and preferably determined to be not less than one half of the activation time for which the clutch E3 is activated. For example, this short stop time may be chosen to be in the range 10 ms to 30 ms for a short activation period lying in the range 20 ms to 40 ms. Conversely, each activation/deactivation series is separated from the next series by a long off time that is identical and that is preferably determined to be no longer than the activation time for which the clutch E3 is actuated. For example, it is possible to choose this long off time to be in the range 30 ms to 50 ms for a long activation period lying in the range 40 ms to 60 ms. Preferably, the first period of activation of the clutch E3 ending in the forced deactivation is of the same duration as the short activation periods that follow it.

Figure 4:
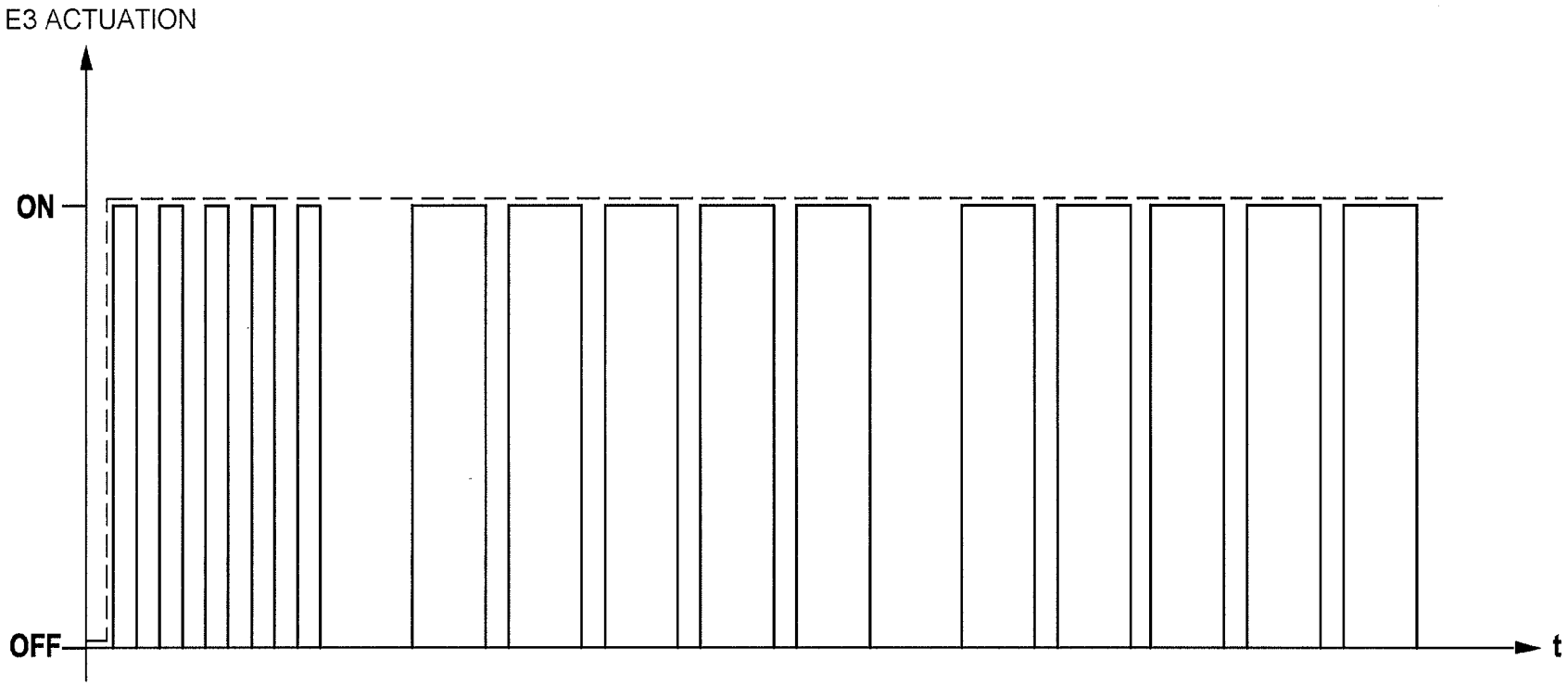
FIG. 4 is an example of a timing diagram of the control of the clutching of the drive rollers in the feed zone of the feed device of the invention.

Thus, for example, as shown in FIG. 4 (the level in dashed lines shows actuation of E3 that is continuous so long as the sensor CN is not activated in prior art feed devices), the duration of a full cycle for a short activation of 25 ms, for a long activation of 40 ms, for a short off period of 10 ms, and for a long off period of 50 ms can thus be computed at:

$$745\ \text{ms}=(5\times25+4\times10)+2\times50+2(5\times40+4\times10).$$

Naturally, this breakdown relating to one series of 5 short activation periods and to two series of 5 long activation periods is given merely by way of indication, and other ratios between short series and long series or between numbers of short and long series are possible.

Once the sensor CN is activated, the clutch E1 continues to be actuated as in prior art devices with, if necessary a time delay of a predetermined duration (e.g. 47 ms for envelopes that are of length greater than 210 mm moving at a speed of 1.5 m/s) depending on the dimensions of the mailpieces and on the speeds at which they are conveyed.

Thus, with the invention, the structure of a conventional feeder is relatively unchanged since, as regards hardware, it is merely necessary to add an additional sensors, and, as regards software, it is merely necessary to define different sequencing for control of the clutch E3 (activation of the clutch E2 remaining, as in the prior art, dependent on activation of E3). Thus, the reliability of the feed device of the invention is unchanged, and separation of the mailpieces is improved significantly, in particular in the event of a large stack.

What is claimed is:

1. A mailpiece feed device designed to be mounted upstream from a franking machine, said device comprising:

at least one mailpiece feed zone for receiving a stack of mailpieces of various formats, said at least one mailpiece feed zone being supported by a first plurality of drive rollers;

a separation zone for individually selecting the mailpieces, said separation zone being supported by a second plurality of drive rollers;

a first clutch means for actuating said first plurality of drive rollers;

at least one sensor CN for detecting passage of said mailpieces as they enter said separation zone; and a control means for subjecting said first clutch means to forced deactivation followed by a first activation/deactivation series comprising at least two activation/deactivation impulses that are of short duration, and a second activation/deactivation series comprising at least two activation/deactivation impulses that are of longer duration so long as the sensor CN is not activated, so as to cause a rapid succession of horizontal movements generating jerky motion on said stack, conducive to facilitating mutual separation of said mailpieces.

2. A feed device according to claim 1, wherein said short duration lies in the range 20 ms to 40 ms.

3. A feed device according to claim 1, wherein said longer duration lies in the range 40 ms to 60 ms.

4. A feed device according to claim 1, wherein each long activation/deactivation impulse is separated from the next by an off period of said predetermined short stop time.

5. A feed device according to claim 1, further comprising means for emitting an error message when said succession of short and long activation/deactivation series becomes greater than a predetermined number.

6. A feed device according to claim 1, wherein said sensor CN is constituted by an optical sensor actuated by passage of an edge of a mailpiece.

7. A feed device according to claim 1, wherein each short activation/deactivation impulse is separated from the next by an off period of predetermined short stop time.

8. A feed device according to claim 4, wherein said short stop time lies in the range 10 ms to 30 ms.

9. A feed device according to claim 1, wherein an activation/deactivation series is separated from another activation/deactivation series by an off period of predetermined long duration.

10. A feed device according to claim 9, wherein said long duration of said off period lies in the range 30 ms to 50 ms.

11. A control method of controlling clutch means for actuating drive rollers supporting a stack of mailpieces of various formats at a feed zone of a mailpiece feed device designed to be mounted upstream from a franking machine, the control being performed as a function of the state of a sensor CN designed to detect passage of said mailpieces as they enter a separation zone that individually selects the mailpieces at the outlet of said feed zone, said control method consisting in:

subjecting said clutch means to a forced deactivation followed by at least a first activation/deactivation series comprising at least two activation/deactivation impulses that are of short duration and a second activation/deactivation series comprising at least two activation/deactivation impulses that are of longer duration so long as said sensor CN is not activated, so as to cause a rapid succession of horizontal movements generating jerky motion on said stack, conducive to facilitating mutual separation of said mailpieces.

12. A control method according to claim 11, wherein said activation/deactivation series of said clutch means comprises a first activation/deactivation series comprising at least two activation/deactivation impulses that is of short duration, followed by a second activation/deactivation series comprising at least two activation/deactivation impulses that is of longer duration, and by a third activation/deactivation series comprising at least two activation/deactivation impulses that are also of longer duration.

13. A control method according to claim 11, wherein the first period of activation of said clutch means ending with said forced deactivation is of the same duration as the periods of activation of short duration that follow.

* * * * *